United States Patent [19]

Wessels

[11] Patent Number: 4,603,571

[45] Date of Patent: Aug. 5, 1986

[54] APPARATUS FOR DRAWING CIRCULAR CUPS FROM NON-CIRCULAR BLANKS

[76] Inventor: Ewald J. H. Wessels, Van Rheede, Alexandra Road, Wynberg 7700, South Africa

[21] Appl. No.: 724,915

[22] Filed: Apr. 19, 1985

[30] Foreign Application Priority Data

Aug. 7, 1984 [ZA] South Africa ..... 84/6126

[51] Int. Cl.[4] ..... B21D 22/00

[52] U.S. Cl. ..... 72/349; 72/347

[58] Field of Search ..... 72/347–351

[56] References Cited

U.S. PATENT DOCUMENTS

| | | | |
|---|---|---|---|
| 444,918 | 1/1891 | Mason et al. . | |
| 1,187,461 | 6/1916 | Knox | 72/342 |
| 1,412,785 | 4/1922 | Jernberg . | |
| 1,580,931 | 4/1926 | Thackray . | |
| 2,270,185 | 1/1942 | Dulmage . | |
| 2,285,903 | 6/1942 | Clark | 72/350 |
| 2,518,483 | 8/1950 | Mapes | 72/349 X |
| 2,600,834 | 6/1952 | Blair . | |
| 2,602,411 | 7/1952 | Schnell | 72/349 X |
| 3,263,637 | 8/1966 | Cox | 72/349 |
| 3,299,689 | 1/1967 | Folney | 72/350 |
| 3,774,561 | 11/1973 | Herbold | 72/349 |
| 3,918,377 | 11/1975 | Herbold | 72/350 |
| 4,185,488 | 1/1980 | Miller et al. | 72/350 |
| 4,309,888 | 1/1982 | Miller | 72/350 |

FOREIGN PATENT DOCUMENTS 883735 7/1953 Fed. Rep. of Germany .

*Primary Examiner*—Leon Gilden

*Attorney, Agent, or Firm*—Larson and Taylor

[57] ABSTRACT

An apparatus and method are disclosed for drawing a metal cup from a metal sheet. Initially, a non-circular blank is provided from the metal sheet by a blanking device. Subsequently, a first drawing device draws a non-circular cup from the non-circular blank such that more stretching takes place where the blank perimeter is closer to the geometrical center of the blank than the stretching which takes place where the blank perimeter is further from the geometrical center of the blank. Finally, a second drawing device draws a circular cup from the non-circular cup. Preferably, the provided blank is hexagonal or rectangular shaped and the associated non-circular cup is then similarly shaped. The second draw device is also preferably a reverse draw device.

10 Claims, 15 Drawing Figures

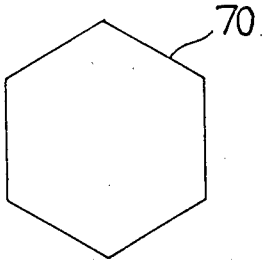
FIG.10
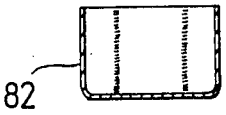
FIG.12
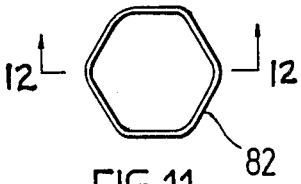
FIG.11
FIG.14
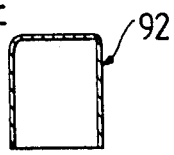
FIG.13
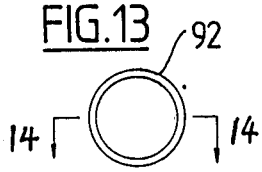
FIG.15
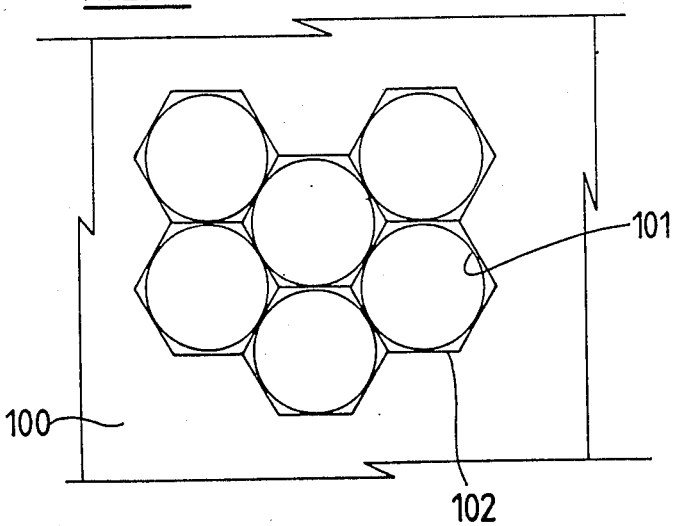

APPARATUS FOR DRAWING CIRCULAR CUPS FROM NON-CIRCULAR BLANKS

FIELD OF THE INVENTION

The present invention relates to a method and apparatus for metal sheet processing. More particularly, the invention relates to metal sheet drawing.

BACKGROUND OF THE INVENTION

The technology is known for drawing cylindrical metal cups from metal sheets. Such cups are, for example, the cups from which drawn metal caps and drawn and wall-ironed metal cans are made.

Conventionally, these cups are drawn from circular disc-shaped blanks, which are cut out from a metal sheet leaving "a waste skeleton". This waste is of no further use and is normally sold as scrap material.

It is an object of the invention to suggest a method and apparatus for drawing cylindrical metal cups, which will utilize the sheet material more efficiently.

SUMMARY OF THE INVENTION

According to the invention, a method of drawing cylindrical metal cups from metal sheets includes the steps of separating non-circular blanks of material from a metal sheet and of drawing cups from such blanks. An apparatus including a means for separating non-circular blanks of material from a metal sheet and a means for drawing cups from such blanks is also provided.

The blanks may be cut or punched from the metal sheet.

The invention also extends to a non-circular metal sheet blank punched or cut from a metal sheet.

The blanks may be hexagonal, or square or substantially hexagonal or substantially square so as to provide a better utilization of the overall area of the metal sheet and to cause a relatively reduced portion of the sheet to be left as "waste skeleton".

The method in accordance with the invention further includes the step of drawing a non-circular cup from the non-circular blank in such a way that more stretching takes place in those areas of the blank where the perimeter is closer to the geometrical centre of the blank than the stretching which takes place in those areas of the blank where the perimeter is further away from the geometrical centre of the blank, and the subsequent drawing of a circular cup from the non-circular cup. The term "stretching" as used herein is meant to describe the lengthening which is produced by stretching or wall ironing or any combination of stretching and wall ironing.

The apparatus of the present invention includes a blanking means for providing a non-circular blank of metal sheet material from the metal sheet, a first drawing means for drawing a non-circular cup from the non-circular blank in such a way that more stretching takes place in those areas of the blank where the perimeter is closer to the geometrical center of the blank than the stretching which takes place in those areas of the blank where the perimeter is further away from the geometrical center of the blank, and a second drawing means for drawing a circular cup from the non-circular cup. Conveniently, the second drawing means illustrated is a reverse draw device.

BRIEF DESCRIPTION OF DRAWINGS

The invention will now be described by way of example with reference to the accompanying schematic drawings.

In the drawings there is shown in

FIG. 10 a top plan view of the blank provided by the apparatus depicted in FIGS. 7–9;

FIG. 11 a top plan view of a non-circular cup drawn by the apparatus depicted in FIG. 7–9;

FIG. 12 a cross-sectional elevation view of the non-circular cup depicted in FIG. 11 taken along the line 12—12;

FIG. 13 a bottom plan view of a circular cup drawn by the apparatus depicted in FIGS. 7–9;

FIG. 14 a cross-sectional elevation view of the circular cup depicted in FIG. 13 and taken along the line 14—14; and FIG. 15 a plan view of a portion of a metal sheet having a pattern for providing circular and hexagonal blanks.

DETAILED DESCRIPTION OF THE PREFERRED EMBODIMENTS

Figure 1:
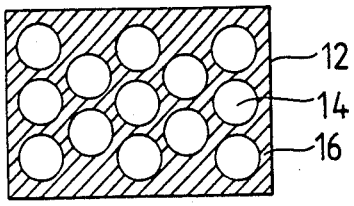
FIG. 1 a plan view of a metal sheet from which the conventional round circular blanks have been cut or punched.

Referring to FIG. 1, a conventional sheet of metal 12 is shown from which round circular cup blanks 14 have been punched. The remainder or waste skeleton material 16 is normally disposed of as scrap material.

Due to the geometric area covered, a circular blank 14 causes a large portion of the sheet 2 to be wasted.

Figure 2:
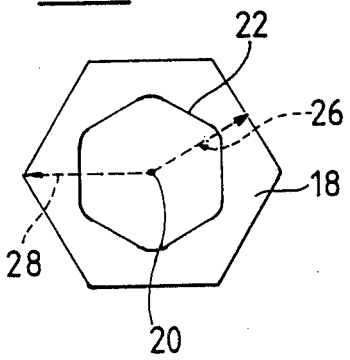
FIG. 2 on a larger scale a plan view of a cup blank in accordance with the invention.

Referring now to FIG. 2, in accordance with the invention, a non-circular cup blank 18 is to be cut from a sheet of metal. This cup blank as illustrated is of hexagonal shape and has a geometric centre 20. The eventual cross-section of the cup to be shaped therefrom is indicated by reference numeral 22.

Figure 3:
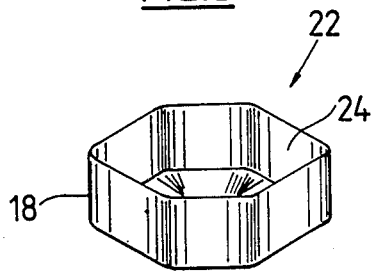
FIG. 3 a pictorial view of a cup formed from a cup blank as illustrated in FIG. 2.

In FIG. 3 the non-circular cup 22 shaped from the cup blank 18 is illustrated. In shaping such a cup 22, th wall 24 is stretched more in a radially outward direction from the geometric centre 20 in those parts where the blank perimeter was closer to the geometric centre 20 of the blank (reference numeral 26 in FIG. 2) than in those parts where the blank perimeter was further away (reference numeral 28 in FIG. 2). It should be appreciated that at the same time that this stretching occurs, material flows sideways in tangential directions from those parts where the blank perimeter was further away from the geometric centre towards those parts where the blank perimeter was closer to the geometric centre.

Figure 4:
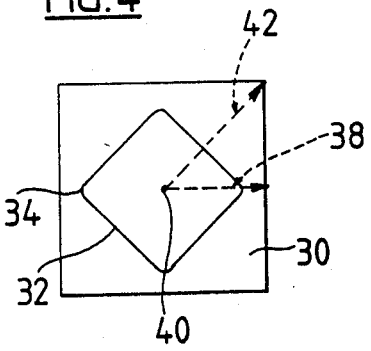
FIG. 4 a plan view of a second embodiment of a cup blank in accordance with the invention.
Figure 5:
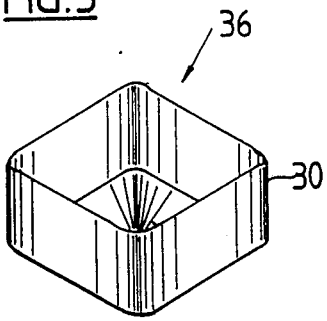
FIG. 5 a pictorial view of a cup formed from a cup blank as illustrated in FIG. 4.

FIG. 4 shows a further embodiment where a square blank 30 is punched from sheet of material. Here the cup will have a shape 32 as shown with rounded corners 34. Once again during the formation of the cup 36, the material in those parts of the blank 38, where the blank perimeter was closer to the geometric centre 40, is stretched more in a radially outward direction from the geometric centre than the material in those parts 42, which are further away from the centre 40. Again, this stretching occurs at the same time that material flows sideways in tangential directions from those parts where the blank perimeter was further away from the geometric centre towards those parts where the blank perimeter was closer to the geometric centre.

In both examples illustrated in FIGS. 2 to 5 the shape of the blank results in a better utilization of the sheet material. In fact in the case of the example illustrated in FIGS. 4 and 5 there should be no or substantially no waste material left.

In both of the examples illustrated, the straight sections of the cross-section of the cups may alternatively be curved, either inwardly toward the geometrical centre of the blank or outwardly toward the primeter of the blank.

Figure 6:
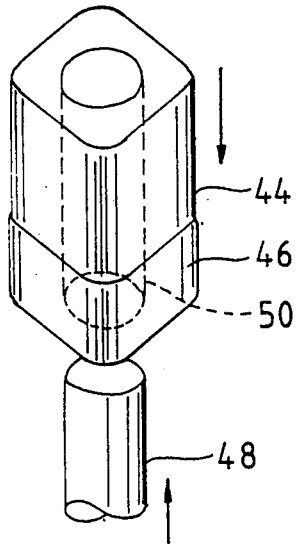
FIG. 6 a pictorial view of an alternative method of forming a cup.

Referring to FIG. 6 the method in accordance with the invention preferably also includes the step of drawing a circular cup from the non-circular cup by a further draw which may be by way of a reverse draw. This final step may be preceded by one or more intermediate stages during which one or more circular or non-circular cups of smaller cross-sectional area than that of the original non-circular cup are drawn as shown in FIG. 6. For this purpose a non-circular punch 44 in a first step forms a non-circular cup 46 and by way of forming the cup 46 into the circular reverse-draw die 50 forms a circular cup.

Figure 7:
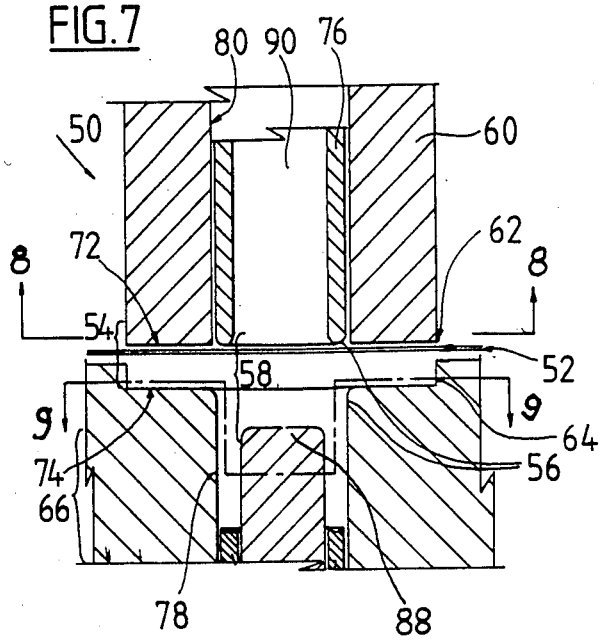
FIG. 7 a schematical cross-sectional side view of a schematically depicted apparatus according to the present invention; for clarity of presentation, many of the details conventionally included in actual compound tools are not shown.
Figure 8:
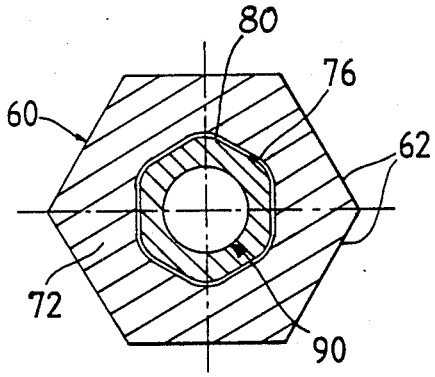
FIG. 8 a cross-sectional bottom view of the apparatus depicted in FIG. 7 taken along the line 8—8.
Figure 9:
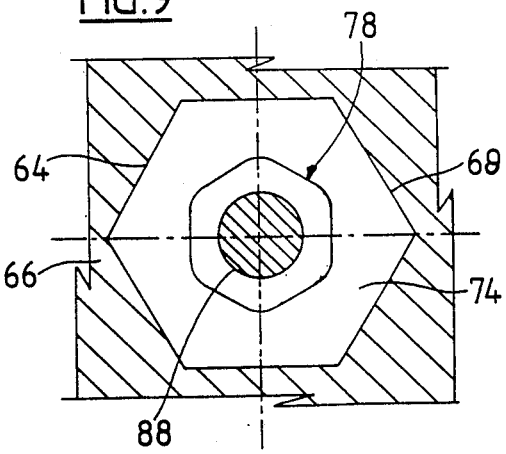
FIG. 9 a cross-sectional top view of the apparatus depicted in FIG. 7 taken along the line 9—9.

Depicted schematically in FIGS. 7 to 9 is a blanking and drawing apparatus 50 which operates on a metal sheet 52 located therein. As shown, blanking and drawing apparatus 50 includes a blanking means 54 for cutting or punching a non-circular blank from metal sheet 52. Blanking and drawing apparatus 50 also includes a first drawing means 56 for drawing the non-circular blank provided by blanking means 54 into a non-circular cup as described above. Finally, blanking and drawing apparatus 50 further includes a second drawing means 58 for reverse drawing of the non-circular cup into a circular cup. It should be appreciated that for purposes of clarity many of the details conventionally included in actual compound tools are not shown.

Blanking means 54 includes a blanking punch 60 having a cutting or punching edge 62. Blanking punch 60 is moved relative to a mating blanking die 64 provided in a base member 66. As shown best with reference to FIGS. 8 and 9, both blanking punch 60 and blanking die 64 have a hexagonal cross-sectional shape with the perimeter cutting or punching edge 62 of blanking punch 60 similarly oriented to and adjacent to a mating edge 68 of blanking die 64. Thus, when relative movement occurs between blanking punch 60 and blanking die 64 with metal sheet 52 located therebetween, a hexagonal blank 70 is provided as depicted in FIG. 10.

Once blank 70 is formed, blank 70 is then held by opposed blank holding surfaces 72 and 74 provided respectively on blanking punch 60 and blanking die 64. Blank holding surfaces 72 and 74 are held in this position with a suitable pressure by suitable devices well known to those of ordinary skill in the art.

First drawing means 56 includes a drawing punch 76 and a drawing die 78. As shown, drawing punch 76 is located in a central cavity 80 provided in blanking punch 60. Drawing die 78 is formed by a suitable cavity located in base member 66 opposite drawing punch 76. As shown best in FIGS. 8 and 9, the mating perimeters of both drawing punch 76 and drawing die 78 are substantially hexagonally shaped. In addition, it should further be appreciated that the straight sides of the hexagonal perimeters of drawing punch 76 and drawing die 78 are not parallel to the straight sides of the hexagonal perimeters of blanking punch 60 and blanking die 64. Rather, as clearly shown in FIGS. 8 and 9, the apexes of the perimeter of blanking punch 60 are closest to the flat sides of the perimeter of drawing punch 76 and vice versa. This same relationship holds for the apexes of the perimeters of blanking die 64 and drawing die 78 as depicted in FIG. 9.

It should be appreciated that as blanking punch 60 moves relative to blanking die 64 to provide blank 70, drawing punch 76 remains in cavity 80 in the position depicted in FIG. 7. Similarly, drawing punch 76 remains in this relative position as blanking punch 60 and blanking die 64 are further moved relative to one another in order to hold blank 70 between blank holding surfaces 72 and 74. Thereafter, by means well known to those of ordinary skill in the art, drawing punch 76 is moved relative to blanking punch 60 and blanking die 64 to draw blank 70 into drawing die 78. In this manner, blank 70 is drawn into a non-circular cup 82 as depicted in FIGS. 11 and 12 (and which is similar to the non-circular cup depicted in FIG. 3). In the same manner that the straight sides of the hexagonal perimeters of drawing punch 76 and blanking punch 60 are not parallel to one another, the perimeter of non-circular 82 cup is similarly offset with the respective apexes adjacent to a respective flat side of the other perimeter. In this manner, as explained above, more stretching takes place in those areas of blank 70 where the perimeter is closer to the geometrical center of the blank than the stretching which takes place in those areas of blank 70 where the perimeter is further away from the geometrical center of blank 70.

Second drawing means 58 includes a drawing punch 88 provided on base member 66 which is located centrally below drawing die 78. Second drawing means 58 further includes a drawing die 90 which is centrally located in drawing punch 76 as shown. As shown respectively in FIGS. 8 and 9, drawing die 90 and drawing punch 88 have mating circular cross-sections.

After the first movement of drawing punch 76 relative to blanking punch 60 and base member 66 to form non-circular cup 82, drawing punch 76 is again moved in the same direction so that drawing punch 88 is received in drawing die 90 provided in drawing punch 76. This causes non-circular cup 82 in this reverse drawing operation to be drawn into a circular cup 92 as depicted in FIGS. 13 and 14. After circular cup 92 is formed, blanking punch 60 and drawing punch 76 are suitably separated from base member 66 and circular cup 92 ejected from blanking and drawing apparatus 50.

Although only single drawing operations have been described above in order to form non-circular cup 82 and circular cup 92, it should be appreciated that both non-circular cup 82 and circular cup 92 can be drawn to these shapes by suitable compound drawing operations or devices.

The invention achieves a significant reduction in waste sheet metal in the drawing of circular cups. It will be apparent that the use of a non-circular blank, such as a square or hexagonal blank, will permit more efficient use of the sheet metal from which the blanks are prepared. However, there is an additional reduction in waste metal achieved by the present invention. This will be apparent from FIG. 15 in which is shown a portion of metal sheet 100 on which is shown the outline 101 of six circular blanks arranged in two rows, three blanks to a row. The circular blanks are of equal diameter and are spaced as closely as possible in each row. The blanks in each row are offset, relative to the adjacent blanks, by the width of the radius of a blank. The rows are also arranged so that they are as close together as possible in the row-to-row direction with the circles in one row in close adjacency to the circles in the adjacent rows. As shown, the circles touch whereas in practice a small space exists. Moreover, in practice, more than three blanks would be present in a row.

It will be recognized that the circular blanks are thus arranged in the most efficient manner with respect to usage of the sheet metal from which the blanks are prepared.

There is also shown on the sheet metal 100 the outline 102 of six hexagonal blanks. It will be apparent that, disregarding the edges of the sheet, the six hexagonal blanks require as much sheet metal as do the six circular blanks. However, it will also be seen that the surface area, and thus the mass, of each of the six hexagonal blanks is larger than the surface area and mass of each of the corresponding circular blanks. Accordingly, given the same original piece of sheet metal, one can obtain six larger (or more massive) circular cups from the hexagonal blank than from the circular blanks. It thus follows that to obtain a can of given geometry and mass, using hexagonal blanks, less mass of sheet material is required than would be required were circular blanks to be used. Put in other terms, it is apparent that a hexagonal blank having a mass equal to the mass of circular blank 101 would be smaller than a hexagonal blank 102 shown in FIG. 15. Such smaller hexagonal blanks would obviously require less sheet metal than would be required for circular blank 102. This reduction in sheet metal requirements is substantial. However, in practice, not all of this savings is realized because when the final circular can or cup is produced, there is always some waste material at the top of the open can which must be trimmed off. Moreover, because of the use of the non-circular blank in accordance with the present invention, there may be more waste trim material than would be produced had a circular blank been used. The amount of this waste trim material, whether in the present invention or in conventional drawing of circular cups from circular blanks, is minimized by appropriate design of the drawing tools. Taking into account that in two well-designed systems, one conventional and one in accordance with the present invention, there may be a slight increase in the trim waste material in the present invention, this increase in waste material will be far exceeded by the substantial reduction in sheet metal requirements mentioned above, yielding a signficant net reduction in sheet metal requirements.

I claim:

1. An apparatus for drawing a metal cup from a metal sheet, comprising a blanking means for providing a non-circular blank from a metal sheet, a first drawing means for drawing a non-circular cup from the non-circular blank in such a way that more stretching takes place in those areas of the blank where the perimeter is closer to the geometrical center of the blank than the stretching which takes place in those areas of the blank where the perimeter is further away from the geometrical center of the blank, and a second drawing means for drawing a circular cup from the non-circular cup.

2. An apparatus as claimed in claim 1, in which the blanking means includes a means for cutting the blank from the metal sheet.

3. An apparatus as claimed in claim 1, in which the blanking means includes a means for punching the blank from the metal sheet.

4. An apparatus as claimed in claim 1, in which the blanking means includes a substantially hexagonal shaped blanking punch and die set such that a blank which is of substantially hexagonal shape is provided.

5. An apparatus as claimed in claim 1, in which the blanking means provides a blank which is of substantially square shape.

6. An apparatus as claimed in claim 1, in which the second drawing means is a reverse draw device.

7. An apparatus as claimed in claim 4, in which the first drawing means includes a substantially hexagonal shaped drawing punch and die set such that a substantially hexagonal cup is drawn from the substantially hexagonal blank with each of the apexes of the cup formed from an area formerly between the adjacent respective apexes of the blank.

8. An apparatus as claimed in claim 7, in which the second drawing means includes a circular shaped drawing punch and die set.

9. An apparatus as claimed in claim 8, in which the blanking punch includes a central cavity in which the hexagonal drawing punch is located and the blanking die includes a central hexagonal cavity forming the hexagonal drawing die.

10. An apparatus as claimed in claim 9, in which the hexagonal drawing punch includes a central circular cavity forming the circular shaped die, and wherein the circular drawing punch is also located centrally in the central cavity of the blanking die and spaced away from both the hexagonal drawing punch and hexagonal drawing die.

* * * * *

UNITED STATES PATENT AND TRADEMARK OFFICE

CERTIFICATE OF CORRECTION

PATENT NO. : 4,603,571

DATED : August 5, 1986

INVENTOR(S) : Ewald J. H. Wessels

It is certified that error appears in the above-identified patent and that said Letters Patent is hereby corrected as shown below:

The term of this patent subsequent to May 13, 2003 has been disclaimed.

Signed and Sealed this

Eighteenth Day of November, 1986

*Attest:*

DONALD J. QUIGG

*Attesting Officer* *Commissioner of Patents and Trademarks*